US009702194B1

(12) United States Patent
Hogan

(10) Patent No.: US 9,702,194 B1
(45) Date of Patent: Jul. 11, 2017

(54) SYSTEMS AND METHODS FOR DIRECTIONAL DRILLING

(71) Applicant: Savant Technologies, LLC, Portland, OR (US)

(72) Inventor: Thomas S. Hogan, Scappoose, OR (US)

(73) Assignee: Savant Technologies, LLC, Portland, OR (US)

( * ) Notice: Subject to any disclaimer, the term of this patent is extended or adjusted under 35 U.S.C. 154(b) by 0 days.

(21) Appl. No.: 15/088,871

(22) Filed: Apr. 1, 2016

(51) Int. Cl.
*E21B 7/06* (2006.01)

(52) U.S. Cl.
CPC ..... *E21B 7/06* (2013.01)

(58) Field of Classification Search
CPC combination set(s) only.
See application file for complete search history.

(56) References Cited

U.S. PATENT DOCUMENTS

| | | | |
|---|---|---|---|
| 2,557,168 | A | 6/1951 | Arps et al. |
| 4,691,203 | A | 9/1987 | Rubin et al. |
| 5,682,956 | A | 11/1997 | Deken et al. |
| 6,739,413 | B2 | 5/2004 | Sharp et al. |
| 6,776,246 | B1 | 8/2004 | Nickel et al. |
| 6,827,158 | B1 | 12/2004 | Dimitroff et al. |
| 7,013,990 | B1 | 3/2006 | Nickel et al. |
| 7,111,693 | B1 | 9/2006 | Self et al. |
| 7,150,331 | B2 | 12/2006 | Cole et al. |
| 7,373,993 | B2 | 5/2008 | Self et al. |
| 7,392,858 | B2 | 7/2008 | Koch et al. |
| 7,510,029 | B2 | 3/2009 | Gunsaulis et al. |
| 7,624,816 | B2 | 12/2009 | Cole et al. |
| 7,654,340 | B2 | 2/2010 | Self et al. |
| 7,663,373 | B1 | 2/2010 | Gard et al. |
| 7,759,824 | B2 | 7/2010 | Gard et al. |
| 7,896,107 | B2 | 3/2011 | Gunsaulis et al. |
| 2007/0247329 | A1 | 10/2007 | Petrovic et al. |
| 2007/0247330 | A1 | 10/2007 | Clark |
| 2010/0243332 | A1* | 9/2010 | Paxton, III ..... B23K 26/38 175/403 |
| 2011/0000665 | A1 | 1/2011 | Chesnutt |

(Continued)

*Primary Examiner* — Kabir A Timory
(74) *Attorney, Agent, or Firm* — Klarquist Sparkman, LLP

(57) ABSTRACT

An underground directional drilling system can comprise a plurality of elongated dual-shaft segments coupled together end-to-end and forming an inner shaft assembly independently rotatable relative to an annular outer shaft assembly. The dual-shaft drilling system can include a communication segment that comprises an outer shaft having first longitudinal portion, a second longitudinal, and a gap portion that provides electrical insulation therebetween. The communication segment can generate voltage differences between the longitudinal portions that cause electrical pulses to periodically transfer across the gap portion to wirelessly communicate drilling related data to the surface. An inner shaft of the communication segment can comprise electrical insulation to avoid creating an electrical short between the first and second longitudinal portions of the outer shaft. The inner shaft assembly can further comprise various sensors, electronics, and communication components, such as a magnetic sensor system that determines relative rotational orientations between the inner and outer shaft assemblies.

22 Claims, 16 Drawing Sheets

(56) References Cited

U.S. PATENT DOCUMENTS

| | | | | |
|---|---|---|---|---|
| 2011/0005838 | A1 | 1/2011 | Granberg et al. | |
| 2011/0042144 | A1 | 2/2011 | Downton | |
| 2013/0128697 | A1 | 5/2013 | Contant et al. | |
| 2013/0319764 | A1* | 12/2013 | Schaaf | E21B 7/06 175/24 |
| 2014/0102792 | A1 | 4/2014 | Lachner, Jr. et al. | |

* cited by examiner

| Prob Points and Condition | | |
|---|---|---|
| P1 | P2 | OPEN |
| P1 | P3 | OPEN |
| P1 | P4 | SHORT |
| P5 | P7 (Pin 5,6,7,8) | SHORT |
| P1 | P6 | OPEN |

SYSTEMS AND METHODS FOR DIRECTIONAL DRILLING

FIELD

This disclosure is related to systems and methods for underground directional drilling.

SUMMARY

Directional drilling systems and methods are disclosed herein that include wireless communication technology for transmitting data between an underground location and a surface location. In one example, an underground directional drilling system can comprise a plurality of elongated dual-shaft segments coupled together end-to-end in a drilling string. The drilling string include an inner shaft assembly that is independently rotable relative to an annular outer shaft assembly, with the inner shafts being mechanically coupled together and the outer shafts being mechanically coupled together.

The dual-shaft system can include a communication segment that comprises an inner shaft and an outer shaft. The outer shaft can comprise a first electrode, a second electrode, a gap portion between the first and second electrodes that provides electrical insulation therebetween. The system can further comprise an electronic communication controller and power source electrically coupled to the first and second electrodes. The communication controller can generate voltage differences between the electrodes that cause electrical pulses to periodically transfer between the electrodes through the gap portion to wirelessly communicate drilling related data from underground to the surface.

The inner shaft of the communication segment can comprise electrical insulation that provides sufficient resistance to avoid creating an electrical short between the opposing electrodes in the outer shaft. The inner shaft can include an insulating gap between opposing axial ends of the inner shaft and can also include an insulating material that forms a radial outer surface of the inner shaft extending between two metallic axial end portions of the inner shaft. The inner shaft can also include a connector rod extending between the axial end portions and positioned within the electrically insulating material. The connector rod can comprise a conductive material, such as copper, but is electrically isolated from at least one of the two axial end portions. For example, the connector rod can be electrically isolated from one axial end portion by one or more insulating spacers, washers, and/or sleeves. A fastener can couple the connector rod to the axial end portion using insulating spacers/washers such that the fastener does not electrically connect the connector rod with the axial end portion. For example, the fastener can extend axially through an aperture in the axial end portion with a threaded portion of the fastener being secured to the connector rod and a head of the fastener being coupled to the axial end portion with a composite washer such that the fastener does not contact the axial end portion.

In some embodiments, the inner shaft and the outer shaft of the communication segment can comprise non-magnetic material. In some embodiments, one or more segments adjacent to the communication segment comprise non-magnetic material. The non-magnetic segments can enhance the operability of certain sensors or devices in and/or near the communication segment that are sensitive to magnetism, such as a magnetic compass sensor system for determining rotational orientations of the inner and outer shaft assemblies.

In some embodiments, the communication segment includes or is coupled to an electrical power source, such as one or more batteries, electrically coupled to the communication controller, the electrodes, and/or to other sensors and devices in and around the communication segment.

In some embodiments, the generated electrical pulses from the communication segment are sufficient to communicate drilling-related data to an above ground receiver when the communication segment is located at an underground depth of more than 100 feet, such as at least 150 feet, at least 200 feet, at least 500 feet, at least 1000 feet, at least 5000 feet, at least 10,000 feet, or at least 15,000 feet.

In some embodiments, the communication segment further comprises or is coupled to at least one sensor electrically coupled to the communication controller, such that data from the at least one sensor can be encoded in wireless communications to the surface. The data from the at least one sensor can comprise any of various types, such as one or more of gamma ray data, vibration data, torque data, rotation speed data, pressure data, temperature data, pitch data, yaw data, inclination and azimuth data, etc. In some embodiments, the communication segment can comprise a receiver configured to receive drilling related data from a sensor located in a different segment of the underground directional drilling system, such as from a sensors location at or near a motor segment adjacent to a drilling head. Such a receiver can comprise an RF receiver, for example, and can be configured to wirelessly receive drilling related data from a sensor located in a different segment of the underground directional drilling system. For example, a distal motor segment can comprise a gyroscopic tool that wirelessly communicates orientation data to a receiver in the communication segment, which in turn wirelessly communicates the data to the surface.

In some embodiments, a non-magnetic dual-shaft communication segment is coupled between at least one proximal non-magnetic dual-shaft segment and at least one distal non-magnetic dual-shaft segment. A motor segment and drilling head can be coupled distally to the non-magnetic segments. A plurality of not non-magnetic (e.g., ferrous based material) segments can be positioned at the proximal portion of the drilling string between a drilling rig and the at least one proximal non-magnetic dual-shaft segment.

An exemplary method for directional drilling comprises (1) causing a dual-shaft directional drilling system to drill a first portion of a bore along a first portion of a predetermined bore path through a geologic formation; (2) after the first portion of the bore is drilled, causing a dual-shaft communication segment of the dual-shaft directional drilling system to generate electrical pulses across an electrical insulator at a modulated frequency to wirelessly transmit drilling-related data from an underground location to an above ground location; and (3) causing an adjustment of at least one drilling-related parameter of the dual-shaft directional drilling system based on the received drilling-related data prior to or while drilling a second portion of the bore along a second portion of the determined bore path.

In some embodiments, the causing of the dual-shaft communication segment of the dual-shaft directional drilling system to generate electrical pulses across the electrical insulator can include causing a sufficient voltage difference to be created between a first electrode located on a first side of the electrical insulator and a second electrode located on a second side of the electrical insulator such that an electrical pulse discharges between the electrodes across the insulator.

In some embodiments, the causing of the dual-shaft communication segment of the dual-shaft directional drilling system to generate electrical pulses across the electrical insulator can include modulating the frequency of the pulses to digitally encode drilling related data.

In some embodiments, the drilling-related data comprises orientation data, such as pitch and yaw data, and wherein the causing an adjustment of at least one drilling-related parameter of the dual-shaft directional drilling system comprises causing an adjustment of a drilling direction of the dual-shaft directional drilling system based on the orientation data. In some embodiments, the method can include causing a wireless communication of the orientation data from a sensor in a motor segment of the dual-shaft directional drilling system to the communication segment, the motor segment being distal to and spaced from the communication segment.

In some embodiments, communications of drilling-related data from an underground portion of a drilling string to a surface location can be performed using fluid pulse telemetry, wherein fluctuations in fluid pressure within the drill string are modulated to encode data that is transmitted along the string. The fluid can comprise water, mud, or other fluids, such as within an annular space between the inner shafts and the outer shafts of the dual-shaft drilling string. Fluid pulse telemetry can be used in conjunction with or independently of other communication technologies disclosed herein.

The foregoing and other objects, features, and advantages of the invention will become more apparent from the following detailed description, which proceeds with reference to the accompanying figures.

DETAILED DESCRIPTION

Figure 1:
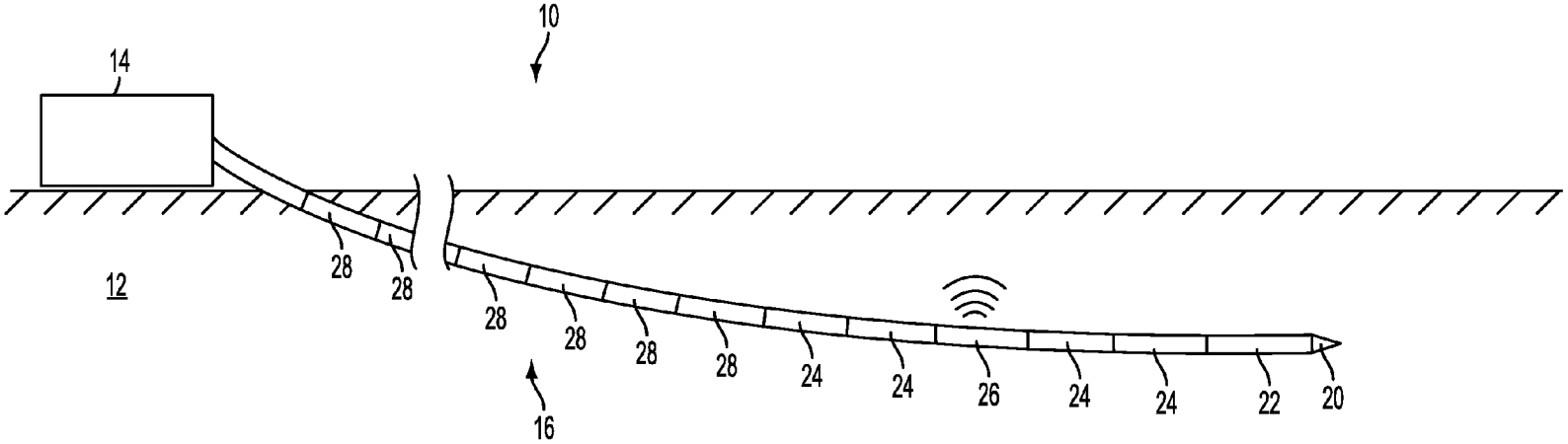
FIG. 1 is a cross-sectional view of an exemplary directional drilling system.

Disclosed herein are systems and methods for underground directional drilling. As used herein, the term "directional drilling" means the practice of drilling underground non-vertical bores. Directional drilling is often performed to create bores for the underground installation of utility conduits, such as for electrical power, communications, fluids, and other utility purposes. In some embodiments, direction drilling methods and systems disclosed herein are used to create underground bores having a first surface entry point and a second surface exit point, such as with a non-linear bore extending between the entry point and exit point. In some embodiments, non-vertical bores can be created having a surface entry point, but no surface exit, such as for accessing an underground target location.

Directional drilling bores often need to be made along non-linear paths. For example, a bore may need to extend under a river or road, around an obstacle, or along the contours of a certain geologic formation. Furthermore, the bore path often must meet certain limitations based on the intended use of the bore. For example, some power lines must remain at least a certain distance below the surface, and certain conduits cannot exceed certain bend curvatures. Laws and regulations can also affect the bore path.

In an exemplary method, a desired bore path is initially determined based on various parameters of the bore environment, the intended use of the bore, the available tools used to perform the drilling, and/or other factors. In some embodiments, a three-dimensional topographical mapping of the surface of the geologic environment of the bore can be made. GPS technologies and/or other surveying technologies can be used to generate such a topographical mapping of the surface. Mapping of underground geologic formations can also be determined, such as to locate undrillable or difficult to drill through underground regions, or to locate other obstacles, such as a previously existing bore or buried utility lines.

Based on the known characteristics of the boring environment, as well as other limitations based on the intended use of the bore, legal limitations, and the available boring equipment, etc., a desired underground bore path can be determined. The bore path can extend from an origination or entry point on the surface to an outlet or exit point on the surface. In other example, one end of the bore can be below ground. The determined bore path can include a three-dimensional path of the bore as well as the diameter of the bore and/or other variable features of the bore.

Any suitable software application(s) can be used to determine a desired bore path based on the given limitations. In some examples, a desired bore path can be determined to an accuracy of less than one centimeter. Once a three-dimensional desired bore path is determined, exact three-dimensional coordinate sets can be determined at a plurality of points along the bore path. These coordinate sets can be used during the boring process to compare the current location of a bore to the desired bore path, and can be used to direct the drilling apparatus along the desired bore path toward each subsequent coordinate set.

The coordinate sets and/or other data related to the desired bore path can be used in conjunction with actual drilling data received during the drilling process to guide and adjust the boring apparatus during drilling.

The terms "proximal" and "distal" are used herein to refer to positions along the drilling string relative to the point of insertion into the earth and/or closer to the drilling rig. The terms "proximal" and "proximally" mean relatively closer axially to the drilling rig and the terms "distal" and "distally" mean relatively closer axially to the drilling head or other end of the drilling string. These terms do not indicate how close or far apart the associated features are, and do not require associated components to be touching or adjacent to each other.

FIG. 1 shows an exemplary directional drilling system 10 inserted into a geologic formation 12. The drilling system 10 can comprise a drilling rig 14 located on the surface at a proximal end of a drilling string 16 that creates and extends through a bore in the geologic formation 12. The drilling string 16 can comprise a plurality of elongated segments having a generally circular cross-section of approximately the same diameter and coupled together end-to-end. The segments can comprise one or more of various different types of segments, including a drilling head 20 at a distal end of the drilling string 16.

The drilling string 16 further comprises additional segments that mechanically, fluidly, and or electrically couple the drilling rig 14 to the drilling head 20 to transfer power from a power source in the drilling rig to the drilling head, such that the drilling head can bore through the geologic formation distally along the predetermined or desired bore path. The number of segments along the drilling string 16 between the drilling rig 14 and the drilling head 20 varies throughout the drilling process. As the bore becomes longer, additional segments are added to the proximal end of the drilling string 16 adjacent to the drilling rig 14, and the existing segments are pushed distally through the bore.

The drilling string 16 can include a motor segment 22 at the distal end of the drilling string just proximal to the drilling head 20. The motor segment 22 is configured to transfer power from the drilling string into a form suitable for powering the drilling head 20. In some embodiments, the motor segment 22 can transfer rotational motion of the drilling string, fluid pressure within the drilling string, and/or electrical power, into a format for driving one or more drill bits or components of the drilling head 20. For example, a mechanical motor segment can be used in conjunction with the dual-shaft drilling string configurations described below, whereby one or both of an inner shaft or an outer shaft mechanically drives the motor segment. In some embodiments, the motor segment can comprise a mud motor or other fluidly driven motor. In some embodiments, a motor can be located at an intermediate location along the drilling string, rather than, or in addition to, at the distal end attached to the drilling head. More information regarding directional drilling systems and methods can be found in U.S. Pub. 2014/0102792, published Apr. 17, 2014, which is incorporated by reference herein in its entirety.

Figure 5:
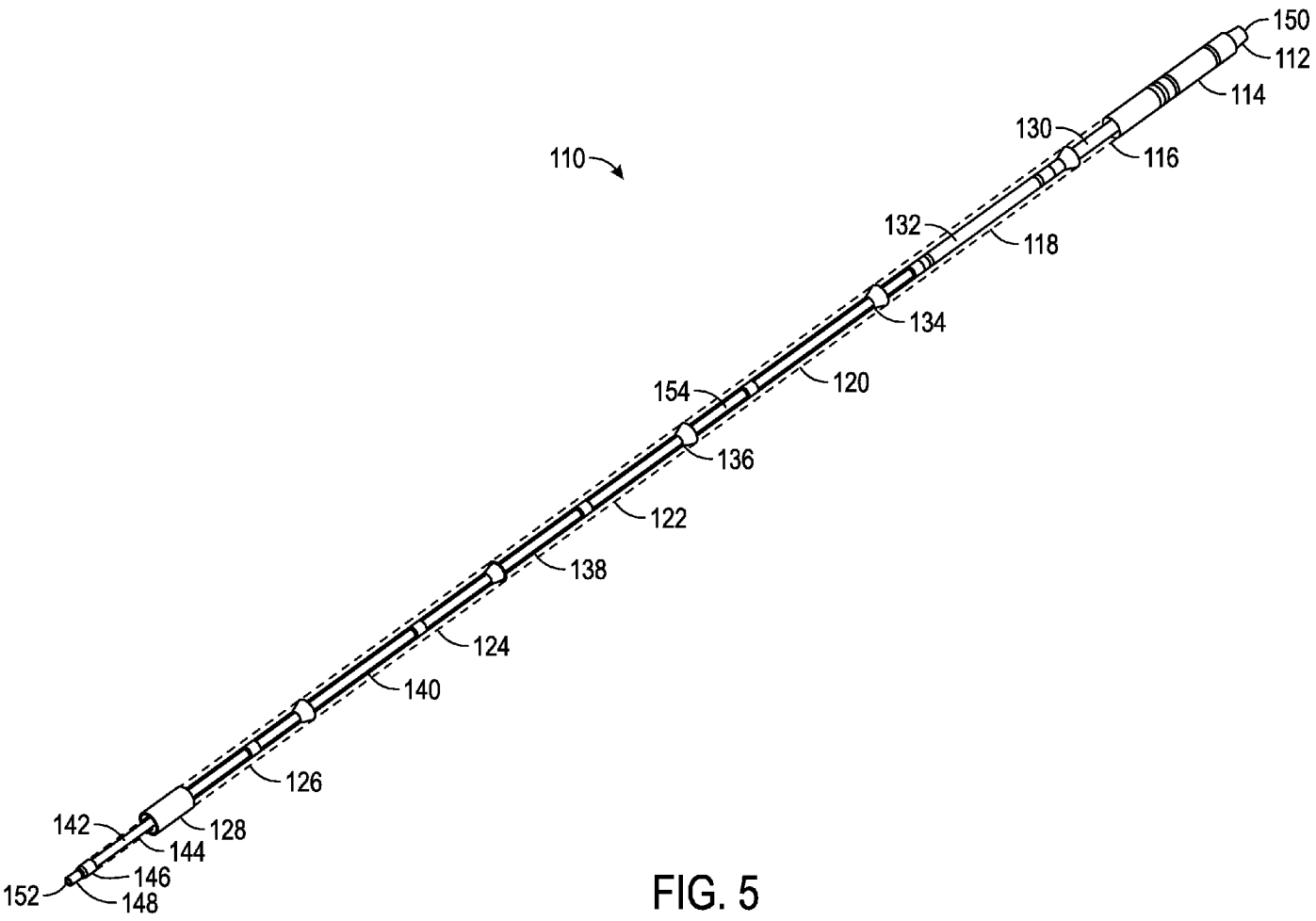
FIG. 5 is a perspective view of another exemplary dual shaft drilling system.

For example, in some embodiment a mud motor is positioned proximal to the communication segment, such as attached to a proximal end of the communication segment. Moving the motor proximal to the communication segment can allow the communications segment, and any other sensory/computing/communicating components, to be positioned closer to the distal end of the drilling string, where they can provide more accurate information about the status of the distal end of the drilling system. The mud motor can turn the inner shaft assembly of the whole distal assembly, including the inner shafts of the communication segment and all components distal to the communication segment. The mud motor can also help rotate the outer shaft assembly. The mud motor can include a power section with a stator, for example, that rotates the distal assembly (as illustrated in FIG. 5, for example). The mud motor can also include a transmission section, or the transmission section can be replaced by the dual shaft assembly with a power coupling mechanism positioned distal to the communication segment to couple to the drilling head.

Figure 2:
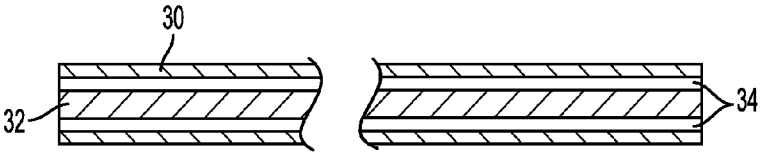
FIG. 2 is a cross-sectional view of an exemplary dual shaft drilling segment.

The drilling string 16 comprises a dual-shaft configuration. As shown in FIGS. 1 and 2, each segment of the dual-shaft drill string (such as the segments 22, 24, 26, and 28 in system 10 of FIG. 1) can comprise an annular outer shaft 30 and an inner shaft 32 positioned within the outer shaft. The inner and outer shafts of each segment can be independently rotatable. The outer shaft 30 of the segments of the drilling string 16 are mechanically coupled to the outer shafts of the adjacent segments of the drilling string, such that the outer shafts are mechanically coupled together from the motor segment 22 (or other distal end component) back to the drilling rig 14. Similarly, the inner shaft 32 of the segments of the drilling string 16 are mechanically coupled to the inner shafts of the adjacent segments of the drilling string, such that the inner shafts are mechanically coupled together from motor segment 22 (or other distal end component) back to the drilling rig 14. The drilling rig 14 can thereby transfer rotational power along the outer shafts 30 to the motor segment 22 and/or transfer rotational power along the inner shafts 30 to the motor segment. The drilling rig 14 may also be configured to transfer axial forces independently to the inner and outer shafts.

In some embodiments, the motor segment 22 can be configured to use rotational power from rotation of the outer shafts 30 for one drilling purpose, and configured to use rotational power from rotation of the inner shafts 32 for another drilling purpose. For example, outer shaft rotation can be used for drilling through one type of geologic material, such as soft dirt, while the inner shaft rotation can be used for drilling through another type of geologic material, such as hard rock, and can also be used for steering. In some embodiments, the drilling string can comprise more than one drilling head and/or more than one motor for independently utilizing the inner and outer shaft rotations.

The dual-shaft segments along the drilling string 16 can include an annular pathway 34 between the inner shafts 32 and the outer shafts 30. In some embodiments, the inner shafts 32 can further comprises in internal lumen (not shown) providing another fluid pathway independent of the annular pathway 34. Furthermore, an outer annular region can exist between the outer surface of the outer shafts 30 and the bore itself, providing another independent fluid pathway through the bore. These fluid pathways can be used to conduct various fluids proximally and/or distally along the bore while the drilling string is in the bore, and while the drilling string is rotating in operation. In some embodiments, water, mud, or other drilling fluids can be pumped distally through the annular pathway 34 to drive the motor segment 22 and/or to flush out cut debris from the distal end of the bore. This fluid can also lubricate the system and/or cool the system. Used fluid, such as fluid containing cut bore material, can be conducted back proximally out of the bore along the external annular region between the outer shafts 30 and the bore walls. In some embodiments, one or more of the pathways along the drilling string can also be used to conduct wires, such for electrical power or communications. Some segments of the drilling string can also include radial conduits that fluidly couple the annular pathway 34 with an internal lumen within the inner shaft. Such radial conduits can provide a fluid bypass route at locations where the annular pathway is obstructed, for example.

The various segments of the drilling string 16 can comprise strong, durable materials in order to effectively transfer large axial and rotational forces along the drilling string. For example, some of the segments can be comprised of steel, stainless steel, titanium, aluminum, alloys, and/or other strong, durable materials. In some embodiments, materials can be selected based in part on electrical and/or magnetic properties, as described below.

The drilling string 16 can comprise at least one communication segment 26 that is configured to transmit drilling-related data from the underground drilling location to an above ground location. An exemplary communication segment 26 can have a dual-shaft configuration like other segments in the drilling string 16, while also including additional components to help perform communications operations. One or more communication segments 26 can be located anywhere along the length of the drilling string 16, and are desirably located close to the drilling head 20 at the distal end portion of the drilling string. More than one communication segment 26 can be included in some drilling strings.

In some embodiments, as shown in FIG. 1, the communication segment 26 can be spaced proximally from the motor segment 22 by one or more other dual-shaft segments, such as non-magnetic dual-shaft segments. As used herein, the term "non-magnetic" means made primarily of substantially non-magnetic material, or material not substantially affected by magnetic fields, such as stainless steel and aluminum, as opposed to metals having a high ferrous content for example. In the example shown in FIG. 1, the communication segment 26 is spaced from the motor segment 22 by two non-magnetic dual-shaft segments 24, and also spaced from the more proximal dual-shaft segments 28 by two additional non-magnetic dual-shaft segments 24. The communication segment 26 can itself also be a non-magnetic dual-shaft segment.

The communication segment 26 can comprise one or more magnetism-sensitive devices, such as a compass or other sensor, the functioning of which requires isolation from substantial amounts materials that are not non-magnetic (e.g., materials with high ferrous content), such as the motor segment 22, the drilling head 20, and/or the proximal dual-shaft segments 28. Thus, by isolating the communication segment 26 via the non-magnetic dual-shaft segments 24 on either side, the one or more magnetism-sensitive devices in the communication segment 26 can function with no substantial interference from magnetic materials. Other than being made of non-magnetic material, the non-magnetic segments 24 can be similar to the proximal segments 28.

Figure 3:
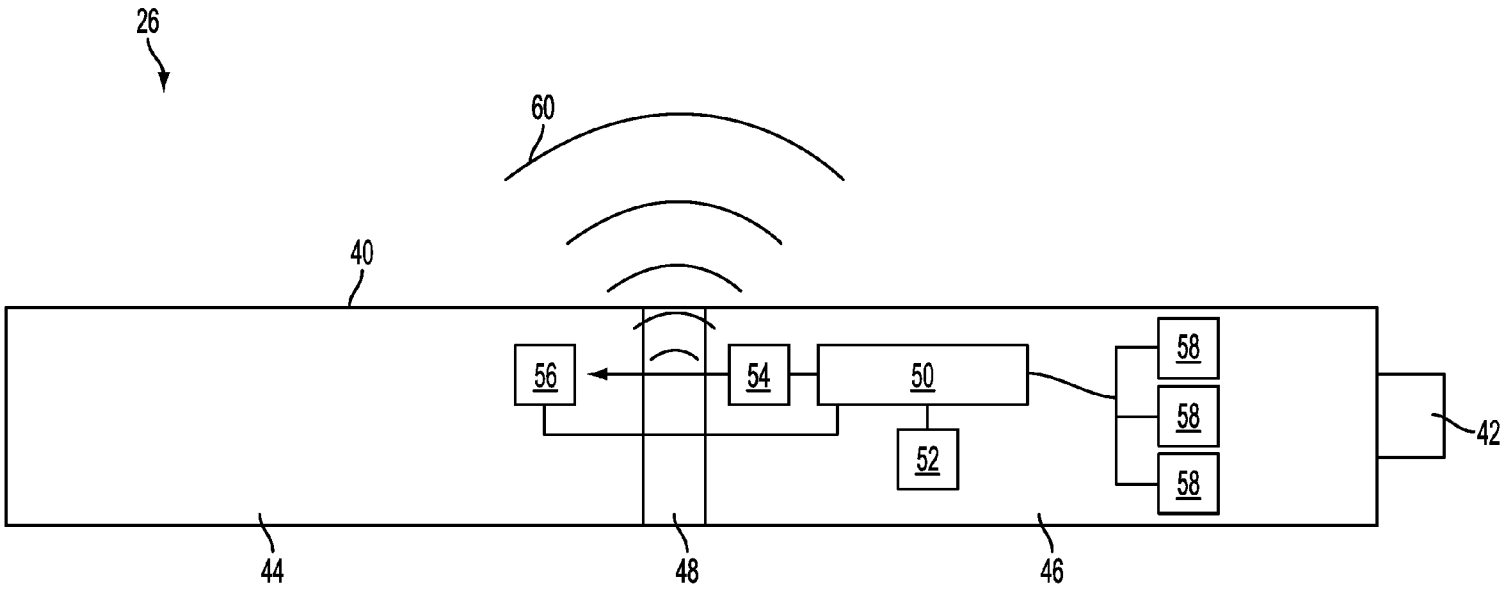
FIG. 3 is a schematic illustration of dual shaft drilling segment comprising a communication system.

A schematic illustration of an exemplary communication segment 26 is shown in FIG. 3. The communication segment 26 comprises an annular outer shaft 40 and an inner shaft 42 that extends through the outer shaft. The outer shaft 40 can comprise a first longitudinal portion 46, a second longitudinal portion 44, and a gap portion 48 between the first and second longitudinal portions 44, 46. The gap portion 48 can comprise material that provides electrical insulation between the first and second longitudinal portions.

The outer shaft 40 can further comprise or be electrically coupled to a communication controller 50 that is electrically coupled to the first longitudinal portion 44, such as at a first electrode 54, on one side of the gap portion 48, and electrically coupled to the second longitudinal portion 46, such as at a second electrode 56, on the other side of the gap portion 48. In some embodiments, the communication controller 50 and the first electrode 54 can be positioned in the first longitudinal portion 46 of the outer shaft and the second electrode 56 can be positioned in the second longitudinal portion 44 of the outer shaft, for example. The communication controller 50 can be configured to generate a voltage difference between the first and second longitudinal portions sufficient to cause an electrical pulse to transfer from one to the other across the gap portion 48.

The communication controller 50 can generate a plurality of such electrical pulses and can modulate the frequency of the pulses to wirelessly communicate drilling related data from the underground drilling location to an above ground location. In some embodiments, the communication segment 26 can be configured to wirelessly transmit data to any above ground receiver that is located within a signal range. The signal range through earth can be up to about 15,000 feet from the communication segment, in some embodiments. The increased vertical depth limits of the communication segment below the surface can be a critical factor that provides advantage over conventional drilling systems, as the communication signals can travel much further through the earth to the surface compared to existing wireless communication technologies currently employed in drilling operations. In some embodiments, the generated electrical pulses from the communication segment are sufficient to communicate drilling-related data to an above ground receiver when the communication segment is located at a vertical depth below the surface of more than 100 feet, such as at least 150 feet, at least 200 feet, at least 500 feet, at least 1000 feet, at least 5000 feet, at least 10,000 feet, and/or at least 15,000 feet.

The wireless pulses can be detected or received at any above ground location within the signal range, whether directly above the communication segment or at any angle from vertical relative to the communication segment. Thus, a receiver or detector need not be located directly above the communication segment. This can be particularly advantageous in situations where the surface location above the communication segment is inaccessible, such is below a body of water, a road, or a building. Relays or similar devices can be used to extend the signal horizontally above ground, such as if the rig and/or receiver is located long distances horizontally away from the communication segment. Above ground, signals can be communicated in any manner, such as via wires or wirelessly.

In some embodiments, one or more relays or other signal transmission devices can be located within the signal range of the communication segment and can receive or detect the wireless pulses, and can relay the received data wirelessly and/or via wires to other relays and/or to a destination where the data can be used, such as at the drilling rig or other relatively stationary location. Such signal transmission devices can be located at various surface locations along the region of the bore path and/or can be embedded in the ground at any depth to increase the wireless range of the communication segment. For example, a signal transmission device located 100 meters underground can allow data to be transmitted from the communication segment to an eventual above ground location from up to an additional 100 meters below the surface. Due to the wireless transmission of data from the communication segment to surface locations, the communication segment and/or other underground segments of the drilling string 16 do not necessarily need to include any wired connection to the surface, though they can include wired connections for other purposes, for example. Wireless communication along the drilling string 16 can be particularly advantageous with a dual-shaft drilling string, as there can be limited or no space along the drilling string to locate wires, and because the inner shafts and outer shafts rotate independently of each other.

In some embodiments, the communication controller 50 can be configured to transmit data via the electrical pulses at certain times during the drilling process. For example, a first portion of the planned bore path can be drilled, and then the drilling process can be stopped to send and receive data from the communication segment underground. The communication segment can redundantly transmit the data any number of times, such as 6 or 7 times over a few seconds or minutes, to improve the accuracy of the data transmission. Once the drilling related data is received, the current characteristics of the drilling string and the completed portion of the bore can be compared to desired or planned characteristics of the bore or other threshold parameters, and based on the comparison, adjustments can be made to the drilling process if needed. For example, if it is determined that the drilling head is currently located a significant distance (such as about a centimeter or more) away from the desired bore path, the drilling head can be redirected to travel back toward the desired bore path, or a new bore path can be determined. The drilling related data can be transmitted from the communication segment while the drilling process is ongoing and/or when the drilling process is stopped. Furthermore, adjustments to the drilling process, such as changes in direction, can be made while the drilling process is ongoing and/or when the drilling process is stopped. Transmitting data from the communication segment and/or making adjustments while drilling is ongoing can reduce the time and cost of the drilling operation, and can increase the overall accuracy of the drilling process. Drilling data analysis and corresponding drilling adjustments can be performed at several intervals along a drilling operation from a bore entry point to a bore exit point or other bore terminus.

The communication segment 26 can further comprise and/or be coupled to one or more sensors, receivers, and/or other devices, such as sensors 58, configured to send data signals to the communication controller 50. Although shown in FIG. 3 as being located in the communication segment, the controller 50 and/or the sensors 58 can be located in other segments of the drilling string in some embodiments, such as in distal portions of the inner shaft assembly (see FIGS. 18 and 19 for example). The sensors 58 can detect and/or transmit various types of drilling related data, such as orientation data, pitch and yaw data, inclination and azimuth data, compass direction data, fluid pressure data, rotation speed data, torque and force data, vibration data, gamma ray data, temperature data, and/or other types of drilling-related data. The data from the sensors 58 can be processed by the communication controller 50 and wirelessly transmitted using modulated pulses between the electrodes 54 and 56. Any one or more of the communication controller 50, the electrodes 54, 56, and the sensors 58 can be powered by a local power source 52, such as one or more batteries, included in the outer shaft 40 and/or in other portions of the dual shaft system, such as in distal portions of the inner shaft assembly. In one example, the controller 50, power source 52, and/or other electrical components can be housed in compartments in the outer shaft 40, such as the compartments 60 shown in the example of FIG. 4. Various electrical/magnetic/sensory/communication components can also be embedded in the outer shaft assembly and/or in the inner shaft assembly apart from the communication segment.

In some embodiments, one or more sensors can be located in the motor segment 22 or in other portions of the drilling string near the drilling head. For example, a gyroscopic sensor can be included in or near the motor segment 22 to determine the orientation of the drill string (e.g., the axial direction of the drill string) at a location closer to the drill head 20 than the communication segment 26. This can help to more accurately determine the position and orientation of the drilling head 20 within the bore.

The sensor(s) in or near the motor segment 22 can communicate data to the communication controller wirelessly (such as via RF signals) and/or through wired connections. In some embodiments, the communication segment 26 includes one or more RF receivers for wirelessly receiving RF signals from sensors in the motor segment 22 and/or from sensors in other segments of the drilling string 16. Received data can be sent to the communication controller for wireless transmission to an above-ground location or other remote location. The gyroscopic sensor can be used to determine orientation data when a magnetic compass-type sensor in the communication segment is not functional or otherwise impaired, such as when the communication segments is an area of relatively high magnetic disturbance (e.g., high ferrous content in the substrate, nearby power lines, etc.).

Figure 4:
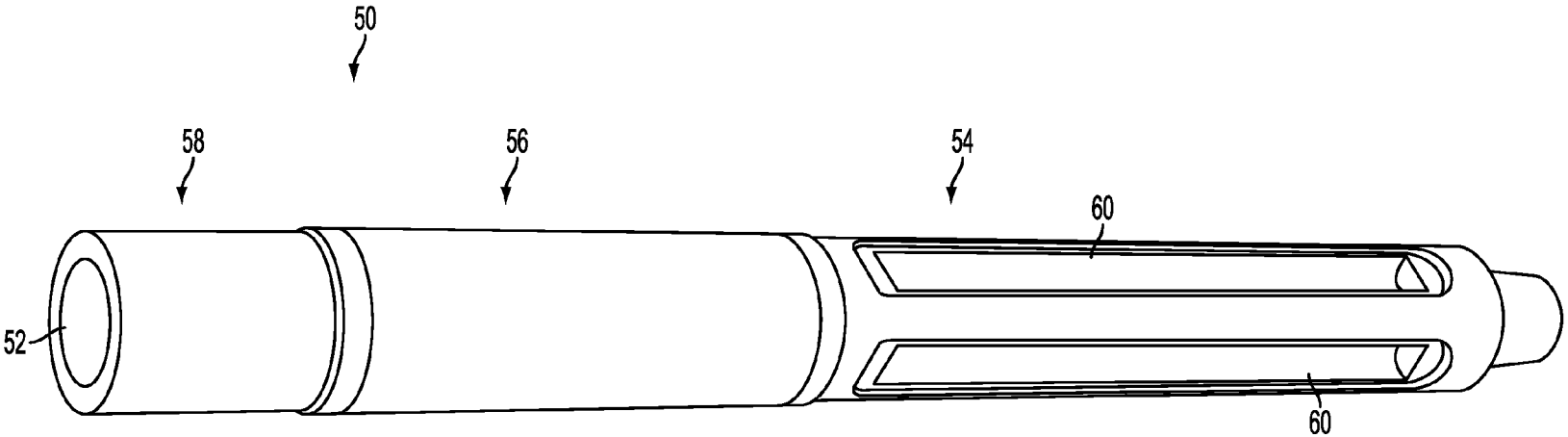
FIG. 4 is a perspective view of one exemplary embodiment of the dual shaft drilling segment of FIG. 3.

FIG. 4 shows an exemplary embodiment of an outer shaft 50 for a communication segment. The outer shaft 50 comprises an inner lumen 52, in which an inner shaft can be positioned. The outer shaft 50 further comprises a first longitudinal portion 54, a second longitudinal portion 58, and a gap portion 56 between the first and second longitudinal portions. The first longitudinal portion 54 comprises compartments 60 that are configured to house the communication controller and batteries. The compartments 60 can be enclosed by affixing external plates to seal the electrical devices within the compartments.

The gap portion can have varying lengths in a communication segment, such as from less than one inch to one foot or more, depending on many factors, such as the size of the drilling string, the depth of the bore, the type and power of the communication controller and electrodes, the material of the gap portion, characteristics of the geologic formations, etc. The material of the gap portion can include any suitable electrical insulating material, such as metallic, ceramic, polymeric, and/or other types of materials. The gap portion can have tapered end surfaces that mate with correspondingly shaped end surfaces of the first and second longitudinal portions, to provide an increased surface area for securing the gap portion to the first and second longitudinal end portions. Adhesives, welds, mechanical fasteners, and/or other means can be used to secure the gap portion and the first and second longitudinal portions together to form an outer shaft having sufficient strength and integrity to function in an underground drilling environment.

The inner shaft segment 42 passing through the outer shaft 40 of the communication segment 26 can be configured to cooperate with the communication functions. For example, the inner shaft can be electrically insulated in such a manner that the inner shaft provides sufficient electrical resistance between the two longitudinal end portions 44, 46 of the outer shaft to avoid forming an electrical short between the two longitudinal end portions of the outer shaft and to allow for sufficient voltage differences to form across the gap portion 48. The resistance provided by the inner shaft can be great enough to allow the communication segment to generate sufficient pulses to communicate as need to the surface. In some embodiments, the inner shaft 42 can include an electrically insulating gap portion or insulation portion separating its two axial end portions. The inner shaft can also include an electrically insulating wrap, coating, or outer layer to help provide electrical isolation between the inner and outer shafts. In some embodiments, electrically insulating bushings, bearings, or spacers can be included between the inner shaft 42 and the outer shaft 40 to provide electrical isolation and help prevent an electrical short between the two longitudinal end portions 44, 46 of the outer shaft.

In some embodiments, disclosed drilling strings can include a system to determine the relative rotational positions of the inner and outer shaft assemblies at a location near the distal end of the drilling string. In some embodiments, a magnetic rotational orientation system can be included wherein one of the inner and outer shafts includes one or more circumferentially located magnetic devices and the other of the inner and outer shafts includes a magnetic sensor system that can detects the circumferential position of the magnetic devices relative to itself to determine the relative rotational position of the inner shaft assembly relative to the outer shaft assembly.

FIG. 5 illustrates an exemplary dual-shaft drilling system 110 that can form a distal portion of an overall dual-shaft directional drilling system that further comprises a distal drilling head, a motor, additional proximal segments, and/or an above ground drilling rig (as generally illustrated in FIG. 1). The system 110 can include a communication segment 114 that is analogous to the communication segments 40 and 50 discussed herein, along with a magnetic location system and various other components. The system 110 includes a proximal end 150 couplable to an above ground drilling rig and a distal end 152 couplable to a distal drilling head.

The outer shaft assembly of the system 110 can include the communication segment 114 adjacent the proximal end, a bearing segment 112 coupled to a proximal end of the communication segment 114, a magnet holding outer segment 120 located distal to the communication segment 114, a distal coupler 128 adjacent the distal end 152 of the drilling string, and/or various other outer shaft segments (e.g., 116, 118, 122, 124, and 126). The outer shaft assembly can have any outer diameter, such as between up to about 12 inches, up to about 10 inches, up to about 8 inches, between 4 inches and 6 inches, between about 4.5 inches and 5.0 inches, and/or about 4.75 inches. The outer shaft assembly can have an inner diameter of up to about 10 inches, up to about 8 inches, up to about 6 inches, such as between 2 inches and 4 inches, between about 2.5 inches and 3.0 inches, and/or about 2.875 inches.

The inner shaft assembly of the system 110 can include a fluid bypass segment 130, an electrically insulated segment 132 coupled to the distal end of the segment 130, various additional load-bearing inner shaft segments (e.g., 134, 136, 138, 140, 142, 144, 146, 148) coupled distally from the electrically insulated segment 132, and/or additional electrical/magnetic/sensory/communication/computing components contained in the inner shaft. For example, the inner shaft segments distal to the insulated segment 132 can comprise and inner lumen that houses various combinations of electrical devices, sensory devices, and computing devices (e.g., see FIGS. 18 and 19), such as at least one power source, one or more sensors, one or more processors, memory with data and/or software stored thereon, firmware, transmitters and receivers, wires, connectors, circuit boards, etc. The inner shaft assembly can have any outer diameter that fits within the outer shaft, such as up to about 10 inches, up to about 8 inches, up to about 6 inches, up to about 4 inches, such as between 1 inch and 3 inches, between about 1.5 inches and 2.0 inches, and/or about 1.75 inches. The inner shaft assembly can have an inner diameter of up to about 6 inches, up to about 4 inches, such as between 1 inch and 2 inches, between about 1.25 inches and 1.75 inches, and/or about 1.5 inches.

In FIG. 5, the inner shaft assembly and outer shaft assembly are shown out of longitudinal alignment with each other for illustrative purposes. In FIG. 5, the inner shaft assembly is shifted distally relative to the outer shaft assembly so that the distal end of the inner shaft assembly is exposed projecting beyond the distal end of the outer shaft assembly. However, when assembled in an operative drilling string, the inner and outer shaft assemblies are aligned, for example such that the inner insulated segment 132 is positioned at least partially within the outer communication segment 114 and the inner fluid bypass segment 130 extends through the outer bearing segment 112.

The drilling system 110 shown in FIG. 5 can vary in length depending on the various factors, such as the types and numbers of electronics and sensors contained in the inner shaft assembly, the purpose of the drilling operation, etc. The overall length of the components shown in FIG. 5 can be between 200 and 400 inches, between 250 and 350 inches, and/or between 300 and 330 inches, such as about 316 inches.

Figure 6:
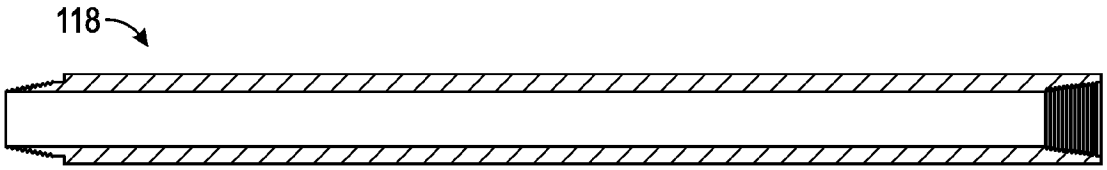
FIG. 6 is a cross-sectional view an outer shaft segment of the system of FIG. 5.

FIG. 6 is a cross-sectional view of the outer segment 118, which comprises a cylindrical wall with an inner lumen for receiving the inner shaft. The segment 118 includes mechanical connection elements at either longitudinal end for coupling to other segments of the outer shaft assembly. The connection elements can comprise threaded connections and/or other mechanical connections. Other segments of the outer shaft assembly (e.g., 122, 124, 126) can be similar structurally to the illustrated outer segment 118.

Figure 7:
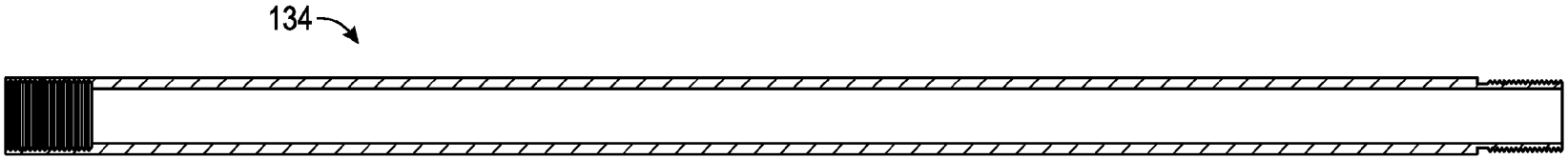
FIG. 7 is a cross-sectional view an inner shaft segment of the system of FIG. 5.

FIG. 7 is a cross-sectional view of the inner shaft segment 134, which comprises a cylindrical wall with a hollow inner lumen and an outer diameter sized to fit within the inner lumen of the outer shaft assembly. The inner shaft segment 134 includes mechanical connection elements at either longitudinal end for coupling to other segments of the inner shaft assembly. The connection elements can comprise threaded connections and/or other mechanical connections. Other segments of the inner shaft assembly (e.g., 136, 138, 140, 144) can be similar structurally to the illustrated inner shaft segment 134.

Figure 8:
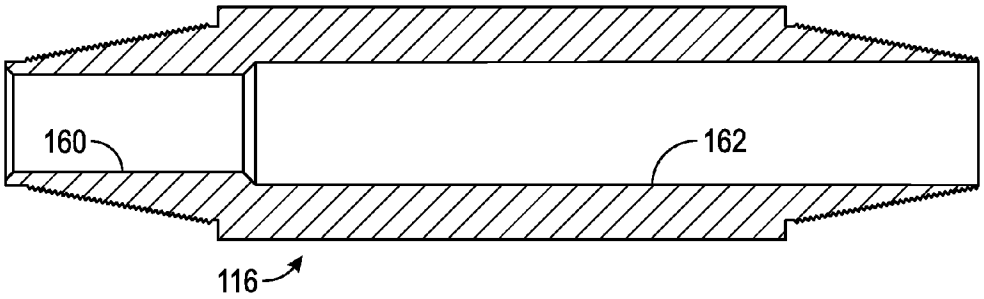
FIG. 8 is a cross-sectional view another outer shaft segment of the system of FIG. 5, including an electrical contact region with the inner shaft.
Figure 9:
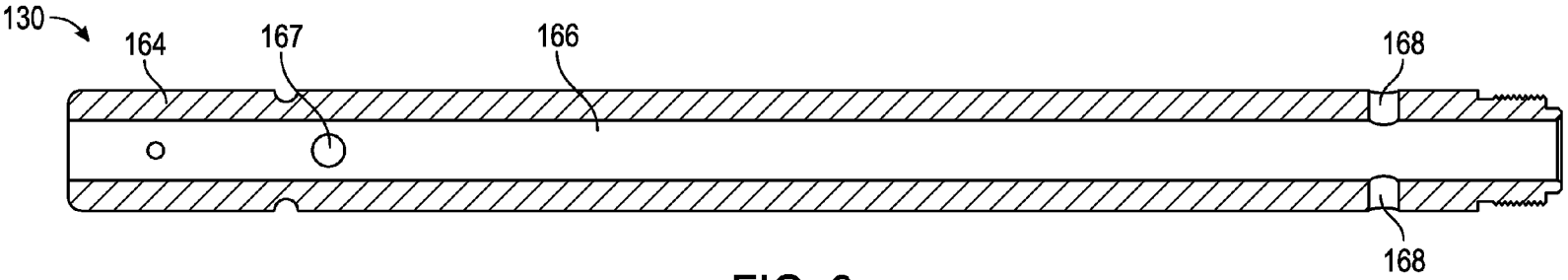
FIG. 9 is a cross-sectional view another inner shaft segment of the system of FIG. 5, including a fluid bypass passageway.

FIG. 8 is a cross-sectional view of the bearing segment 112 of the outer shaft assembly and FIG. 9 is a cross-sectional view of the fluid bypass segment 130 of the inner shaft assembly that extends through the bearing segment 112. As noted above, the drilling string can include an annular passageway between the inner shaft assembly and the outer shaft assembly along most of the length of the drilling string. The annular passageway can conduct various fluids down the drill string, separate from fluids conducted in the space between the outer surface of the outer shaft assembly and the surrounding earth. However, in some locations, the inner shaft assembly and the outer shaft assembly can have a tighter fit such that the annular passageway is narrowed and/or blocked. For example, the bearing segment 112 includes a narrowed inner bore 160 that forms a narrowed fit around the outer surface of the fluid bypass segment 130, such that fluid flow therethrough is restricted. The bore 160 can have an inner diameter that is slightly larger than the outer diameter of the inner segment 130. For example, the bore 160 can have an inner diameter of about 2.02 inches while the outer diameter of the inner segment 130 can be about 1.89 inches. The tight fit through the bore 160 can provide a mechanical limitation or bearing to control the radial position of the inner shaft assembly within the outer shaft assembly, and/or can provide an electrical connection between the inner shaft assembly and the outer shaft assembly. Because the annular fluid passageway is restricted through the bore 160, the inner shaft segment 130 can include a fluid flow bypass route including radial conduits 167 and 168 and inner lumen 166. For example, fluid from the annular passageway can enter the radial conduit 167 just proximal to the bore 160, then flow distally through the lumen 166 bypassing the bore 160, and then flow radially out through the conduit 168 into the portion of the annular passageway formed by the larger diameter bore 162 of the outer bearing segment 112. The bore 162 can have an inner diameter of about 2.5 inches, for example.

The fluid bypass segment 130 can optionally include a proximal connector 164 having a hexagonal cross-sectional profile for coupling to other proximal segments of the inner shaft assembly. The distal end of the segment 130 can have a threaded connector, or other connector, for coupling to the insulating segment 132. The bearing segment 112 can also include connection features at either axial end, with the distal end being coupled to the communication segment 114 and the proximal end being coupled to other proximal outer shaft segments.

Figure 10:
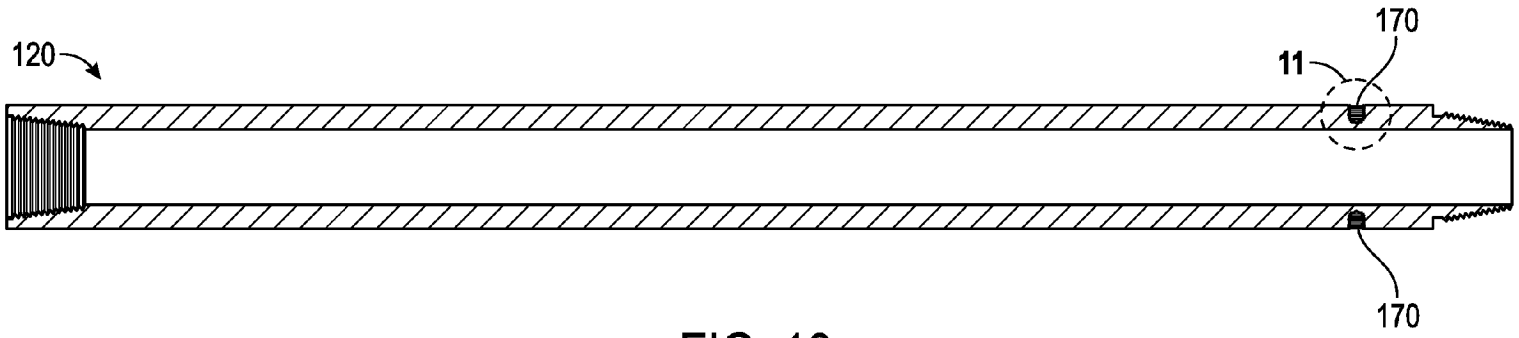
FIG. 10 is a cross-sectional view another outer shaft segment of the system of FIG. 5, including magnetic elements that help determining the relative orientations between the inner and outer shafts.
Figure 11:
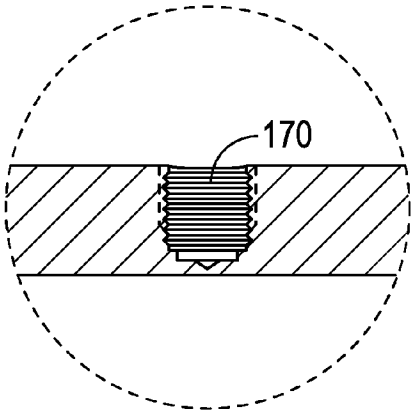
FIG. 11 is an enlarged view of one of the magnetic elements of FIG. 10.
Figure 12:
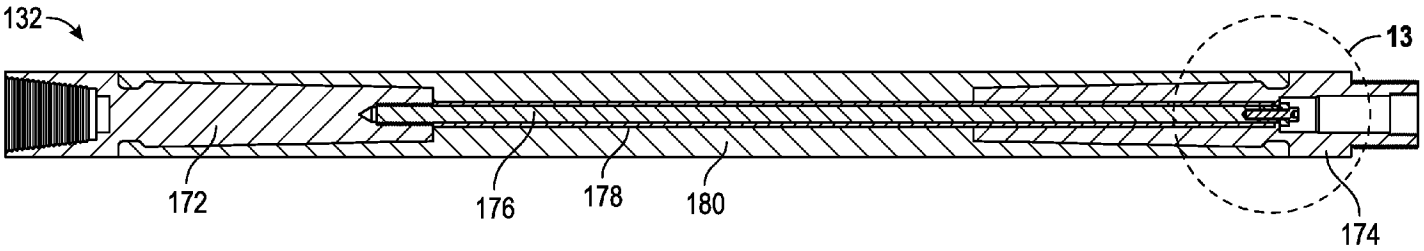
FIG. 12 is a cross-sectional view an inner shaft segment of the system of FIG. 5, including an electrically insulated gap separating the two axial ends of the segment.
Figure 31:
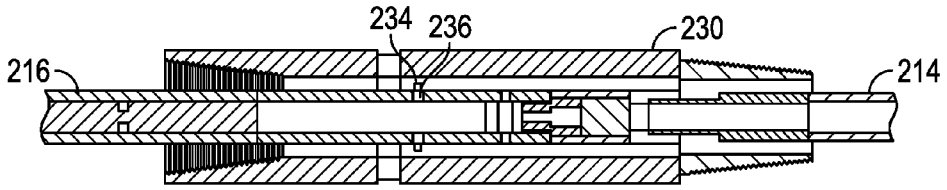
FIGS. 31 and 32 are enlarged views of portions of FIGS. 18 and 19 showing a portion of the outer shaft comprising magnetic elements positioned around a portion of the inner shaft comprising magnetic sensory components.
Figure 32:
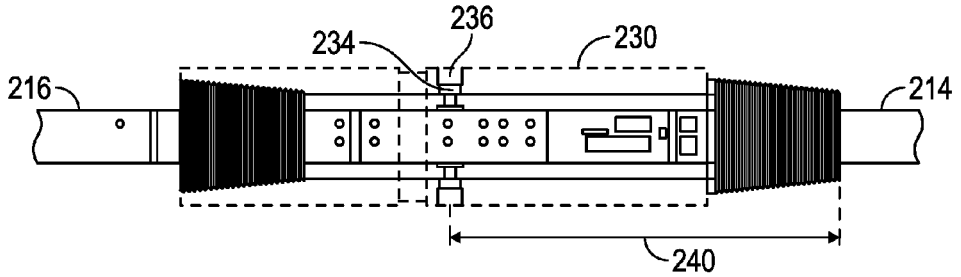
Figure 33:
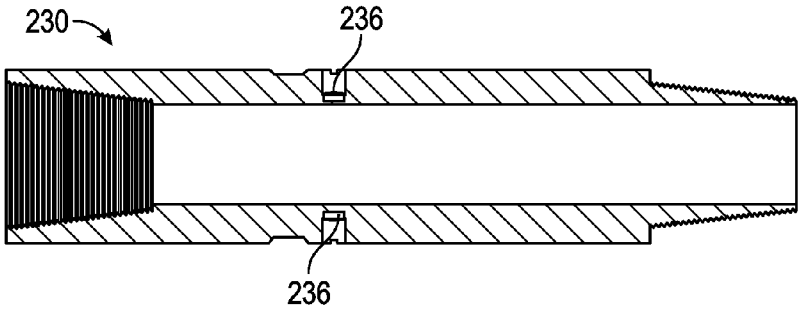
FIGS. 33 and 34 show the outer shaft portion of FIGS. 31 and 32.
Figure 34:
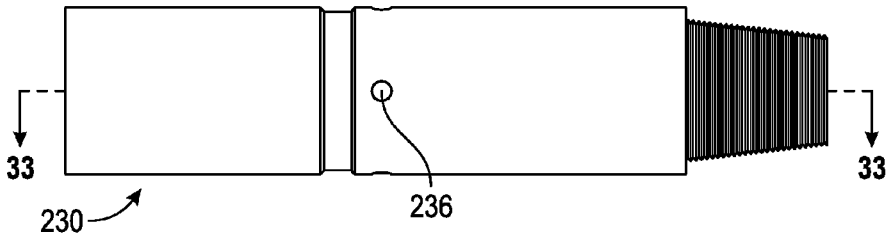

FIGS. 10 and 11 illustrate an exemplary magnet holding segment 120 of the outer shaft assembly. The segment 120 can include one or more magnetic devices, such as the two screw assemblies 170 shown, mounted in the radial wall in a fixed position relative to the rest of the outer shaft. The screw assemblies 170 can comprise a metal screw portion (e.g., steel) and a magnet portion, such as a magnet positioned under the screw portion. The magnet holding segment 120 can be used in combination with a magnetic sensor module in the inner shaft assembly to determine the relative rotational orientation between the inner and outer shaft assemblies, as discussed further herein with reference to FIGS. 31 and 32.

Figure 13:
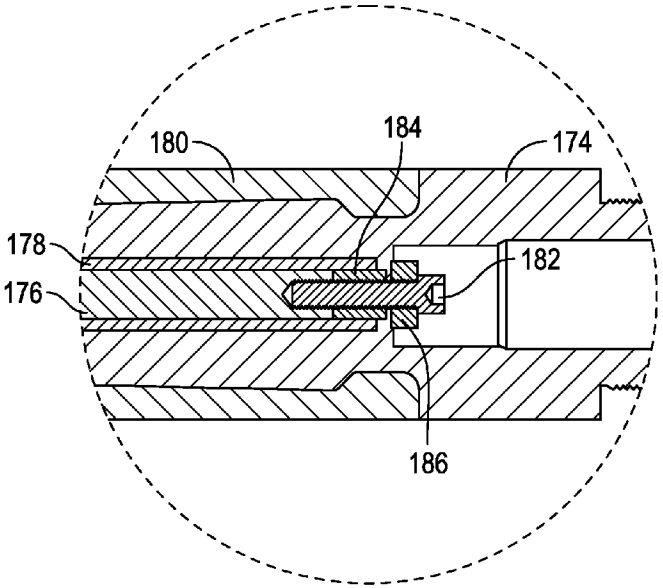
FIG. 13 is an enlarged view of the electrically insulated gap shown in FIG. 12.

FIGS. 12-17 show an exemplary embodiment of the electrically insulating inner shaft segment 132. The segment 132 is positioned at least partially within the outer communication segment 114 and can provide substantial electrical resistance between the longitudinal ends of the outer communication segment 114 and thereby restrict or prevent the inner shaft from creating a direct electrical connection (e.g., a short circuit) between the two longitudinal end portions of the communication segment 114. This allows the communication segment to generate voltage differences across the intermediate insulating portion and thereby generate the desired electromagnetic pulses. The inner insulating segment 132 can comprise a first metallic end portion 172, a second metallic end portion 174, a metallic connector rod 176 extending between the two end portions, an inner insulating layer 178 around the connector rod, and outer insulating layer 180 forming an outer radial surface between the end portions, one or more insulating spacers and/or washers 184, 186, and a fastener 182 that secures one end of the connector rod 176 to the end portion 174 using the spacer 184 and washer 186 (which can comprise an electrically insulating composite material, for example) to avoid forming a direct electrical contact between the metallic fastener 182 and the metallic end portion 174 (FIG. 13). The connector rod 176 can be directly secured to the other end portion 172, as shown with a threaded connection. The end portions 172, 174 can comprise any sufficiently strong material, such as steel, and the connector rod 176 can comprise various metallic materials, such as copper. The radial surface of the connector rod 176 can be separated from the end portion 174 and from the outer insulating layer 180 via the inner insulating layer 178, which can comprise a fiber glass material or other composite material, for example.

The segment 132 can have an axial length (from the shoulder of end portion 172 to the shoulder of end portion 174) between 20 inches and 60 inches, between 30 inches and 50 inches, between 35 inches and 45 inches, between 36 inches and 40 inches, and/or between 37 inches and 39 inches, such as about 38.5 inches or about 37.5 inches. The axial length of the outer surface of the outer insulating layer 180 can be between 15 inches and 55 inches, between 25 inches and 45 inches, between 30 inches and 40 inches, and/or between 32 inches and 34 inches, such as about 33.5 inches. The segment 132 can have any outer diameter that fits within the outer communication segment 114, such as up to about 10 inches, up to about 8 inches, up to about 6 inches, up to about 4 inches, such as between about 2 inches and about 3 inches, between about 2.2 inches and about 2.6 inches, and/or between about 2.3 inches and about 2.5 inches, such as about 2.412 inches.

Figure 14:
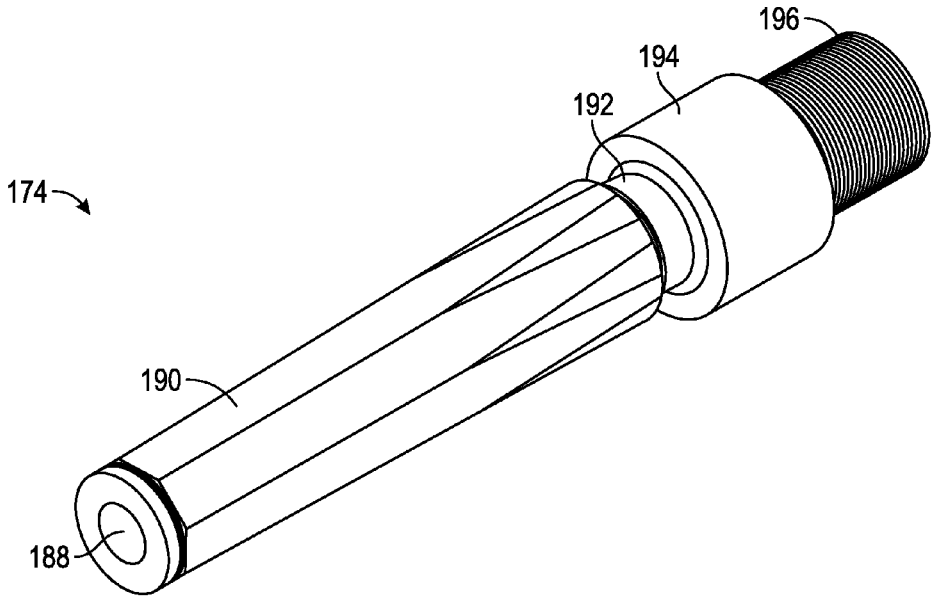
FIG. 14 is a perspective view of one axial end component of the inner shaft segment shown in FIG. 12.
Figure 15:
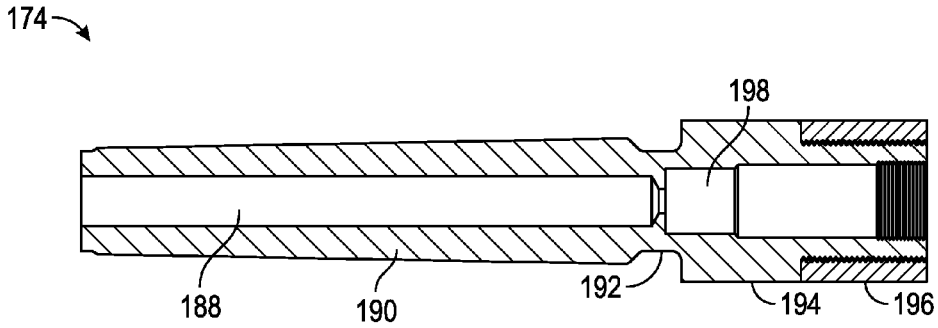
FIG. 15 is a cross-sectional view of the axial end component shown in FIG. 14.
Figure 16:
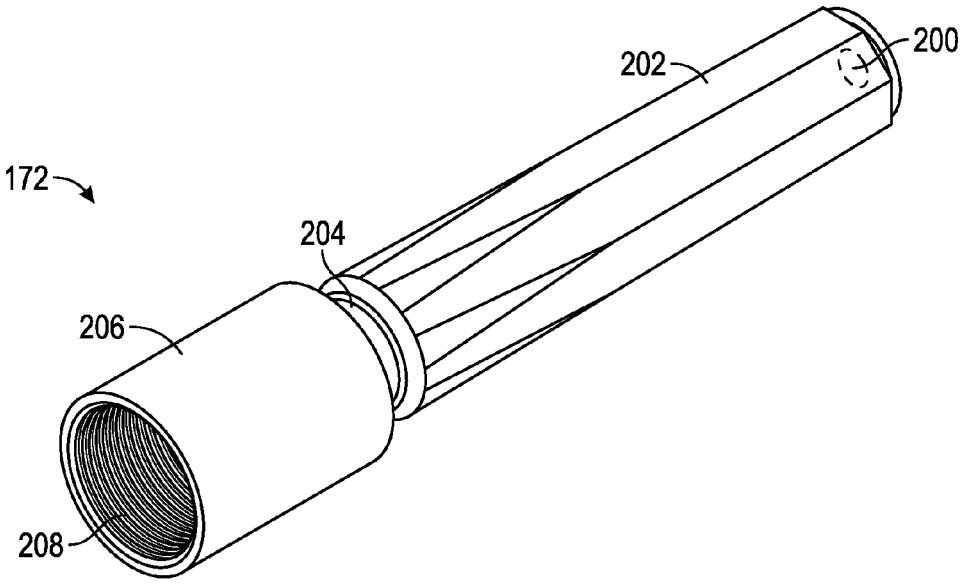
FIG. 16 is a perspective view of a second axial end component of the inner shaft segment shown in FIG. 12.
Figure 17:
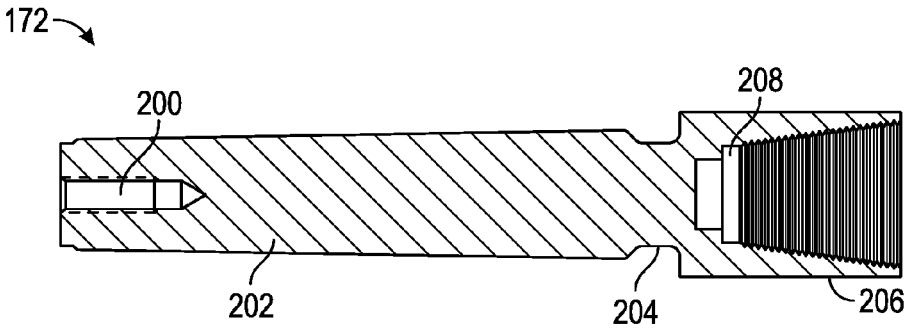
FIG. 17 is a cross-sectional view of the axial end component shown in FIG. 16.

FIGS. 14 and 15 show an exemplary configuration of the end portion 174, and FIGS. 16 and 17 show an exemplary configuration of the end portion 172. The end portion 174 can include a proximal recess 188 that receives the connector rod 176, spacer 184, and inner insulating layer 178, and can comprise a distal recess 198 that receives the washer 186 and fastener 182. The fastener 182 can extend through an aperture coupling the recesses 188 and 198 but the fastener can remain spaced from and not in contact with the end portion 174. The end portion 174 can have a tapered and polygonal outer surface 190 (comprising flat, polygonal surfaces, for example), a necked portion 192, a cylindrical portion 194, and a threaded connector 196.

The opposite end portion 172 (FIGS. 16 and 17) can comprise a distal recess 200 that receives the connecting rod 198 and a proximal recess 208 that has internal threads for coupling to the fluid bypass segment or another inner shaft segment. The outer surface can include a tapered and polygonal surface 202, a necked portion 204, and a cylindrical portion 206.

The outer insulation layer 180 (e.g., fiberglass) can extend from between the cylindrical portions 194 and 206, forming a continuous outer radial surface equal in dimension with the cylindrical portions. The layer 180 can extend into the necked portions 192 and 204 to provide a physical interlocking connection with the end portions 172 and 174 to resist axial separation. Further, the flattened, polygonal surfaces 190 and 202 can provide an interface with the outer layer 180 that resists relative rotational motion between the layer and the end portions. The insulating material and the axial length of the outer layer 180 can help prevent an electrical connection being formed between the opposing longitudinal end portions of the communication segment 114.

Figure 18:
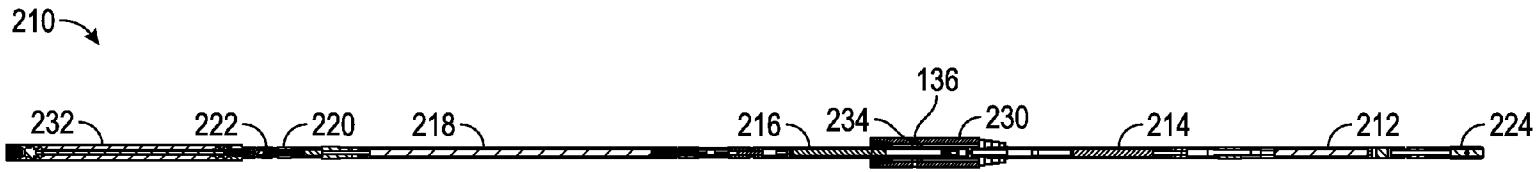
FIG. 18 is a cross-sectional view of an exemplary inner shaft portion for a dual shaft drilling system, including various electronic, magnetic, and sensory elements.
Figure 19:
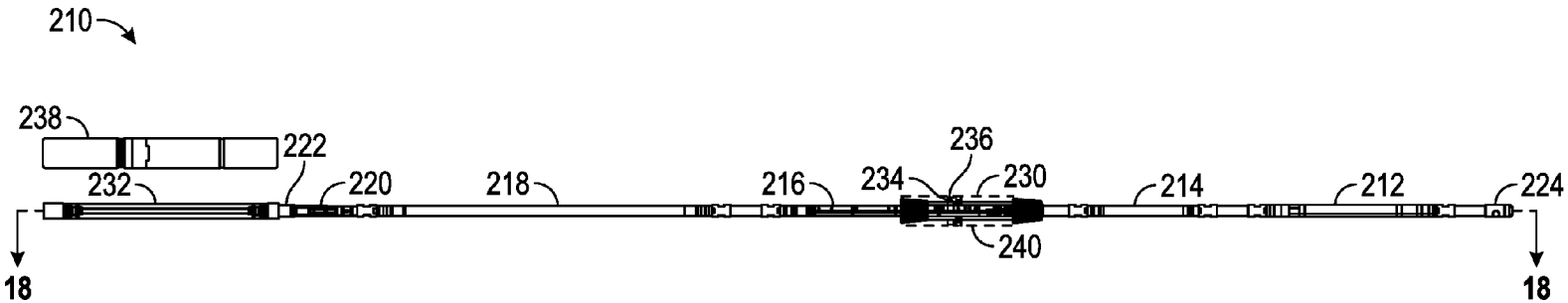
FIG. 19 is a plan view of the inner shaft portion of FIG. 18, along with an outer shaft communications segment shown in parallel alignment.
Figure 20:
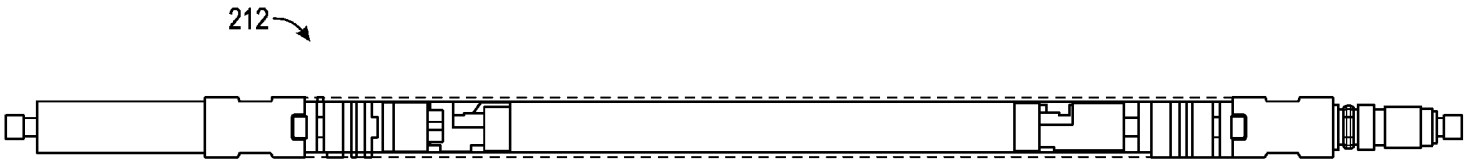
FIGS. 20-23 are plan views of four segments of the inner shaft portion shown in FIGS. 18 and 19.
Figure 21:
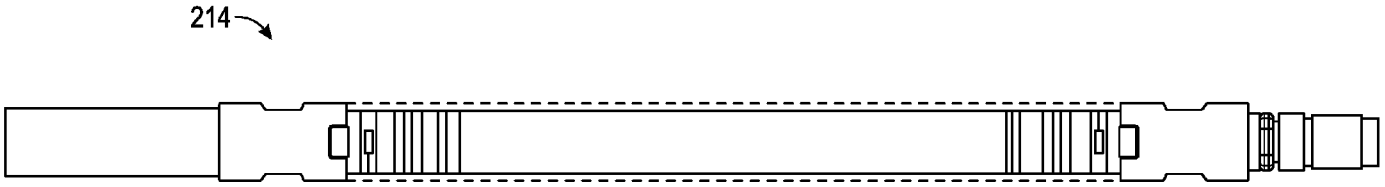
Figure 22:
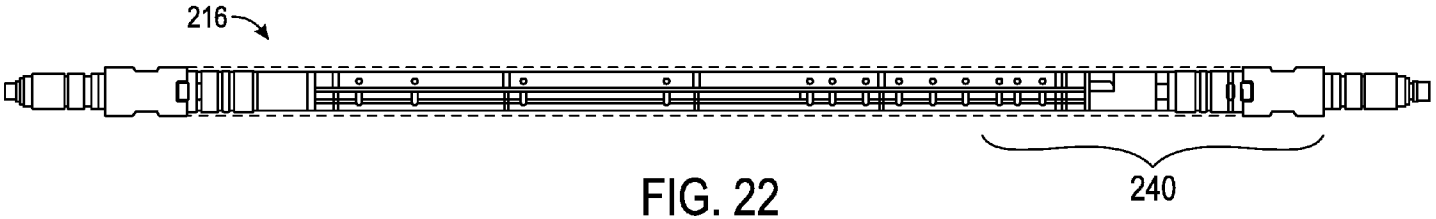
Figure 23:
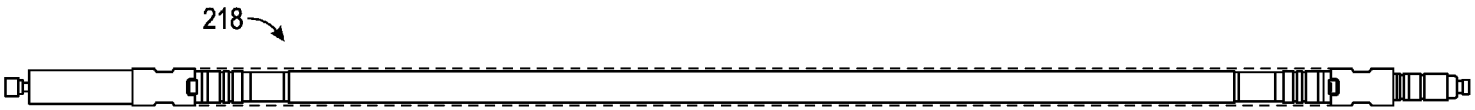
Figure 25:
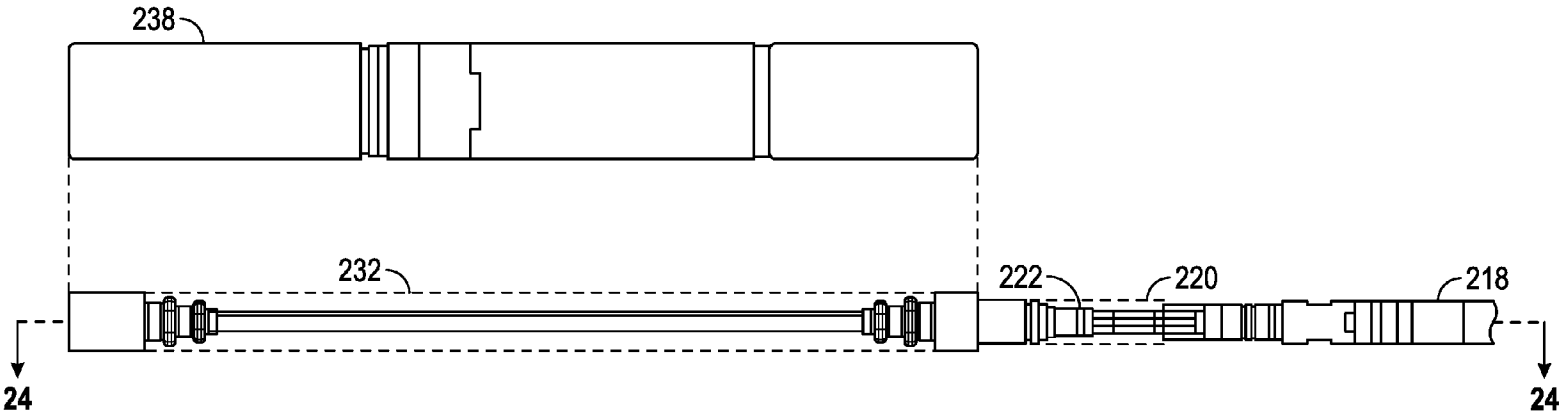
FIG. 25 is an enlarged view of a portion of FIG. 19 showing an electrically gapped segment of the inner shaft in parallel with a communications segment of the outer shaft.
Figure 26:
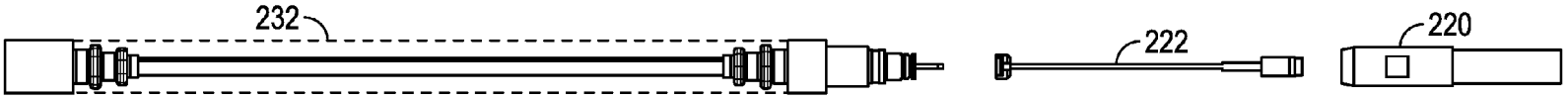
FIGS. 26-30 illustrate various electrical connections between portions of the inner shaft.

FIGS. 18 and 19 illustrate an exemplary inner shaft subsystem 210 that can be included in the inner shaft assembly of disclosed dual-shaft drilling systems. The components in the subsystem 210 are primarily electrical, magnetic, sensory, and/or communication based components, while they may also provide structural and force transmission properties as well. The subsystem 210 can include an electrically insulating segment 232 that is analogous to the segment 132 described above (the segments 132 and 232 can be used alternatively). Similarly, FIGS. 19 and 25 illustrate the subsystem 210 in parallel with an outer communication segment 238 that is analogous to the communications segment 114 described above (the communication segments 114 and 238 can be used alternatively). The communication segment 114 can have about the same axial length as the inner insulating segment 132, for example.

As shown in FIGS. 20-23, the subsystem 210 can further include a sensor module 212, a spacer assembly 214, an electronics module 216, and a battery module 218 coupled in axial alignment. The modules 212-218 can be positioned within the inner lumens of inner shaft segments 134, 136, 138, and 140, for example (see FIG. 5). The modules 212-218 can comprise outer pressure barrels or other casings that seal off the inner electronic equipment for water, mud, oil, or other contaminants. The outer pressure barrels can fit snugly and securely inside the inner shaft segments (e.g., 134, 136, 138, and/or 140). Insulation and/or vibration absorbing material can also be included therebetween to reduce damage/shock to the modules inside. The modules 212-218 can have an outer diameter between about 1 inch and about 2.5 inches, between about 1.5 inches and about 2.0 inches, and/or about 1.75 inches. The modules 212-218 can have a collective axial length of less than 250 inches, less than 200 inches, and/or less than 190 inches, such as about 178 inches. The overall subsystem 210, including the segments 232 and 224, can have an axial length of less than 300 inches, less than 270 inches, and/or less than 260 inches, such as about 249 inches. The axial length can be significantly shorter if one or more of the subsystem modules 212-218 is removed.

The sensor module 212 can include various sensory components, such as described elsewhere herein. The electronics module 216 can include various electronic hardware and software components, such as a processor, transmitters and receivers, memory, firmware, software, stored data, etc. The electronics module 216 can also comprise magnetic sensory components 240 (FIG. 22) that can be positioned radially within the magnetic screw assemblies 170 of the magnet holder segment 120 (FIGS. 10 and 11). FIGS. 18 and 19 show an alternative magnet holder segment 230 for the outer shaft (shown in greater detail in FIGS. 31-34) that includes two magnets 234 (e.g. disk shaped magnets) having the same polarity mounted at discrete circumferential positions, such as at diametrically opposite sides of the segment. The magnets 234 can take the form of a set screw, for example, or can be held in place by set screws (such as screws 236). The outer segment 230 can be used alternatively in place of the segment 120 in the outer shaft. The inner and outer shaft segments in the region of the magnet assemblies 234/236 can comprise non-magnetic materials to avoid interference. The screws 236 can optionally be removed to allow replacement or swapping of the magnets 234 to adjust the strength of the magnets, for example.

In an exemplary method, when the inner and outer shaft assemblies stop rotating, the absolute orientation of the drill string can be determined (e.g., position relative to gravity direction) and the relative rotational position between the inner and outer shafts can be determined. A sensor can be included (e.g., in the inner shaft assembly, such as the sensor module 212) that measures the direction of gravity relative to the axial direction of the drilling assembly near the distal end, and from that sensory input the computing system can determine the angles of the drilling system relative to gravity, such as in terms of pitch, yaw and roll, or in terms angles of inclination relative to horizontal, or other orientation metrics. This data can include the rotational orientation of the inner shaft about the longitudinal axis. The system can then also determine the rotational position of the magnets 234 in the outer segment 230 relative to the inner shaft to determine the rotational orientation of the outer shaft assembly.

Figure 24:
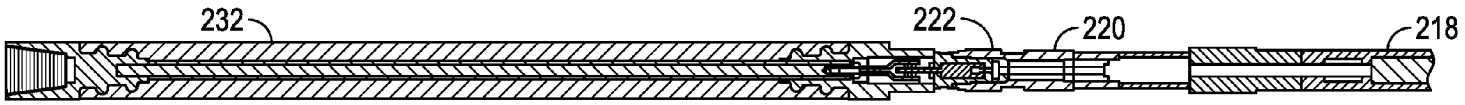
FIG. 24 is an enlarged view of a portion of FIG. 18 showing an electrically gapped segment of the inner shaft connected to other components of the inner shaft.
Figure 27:
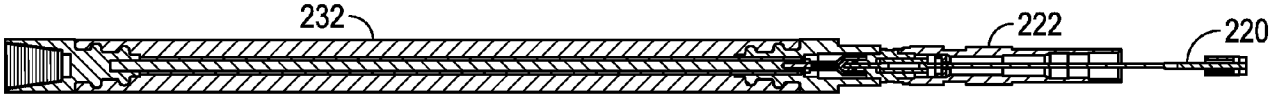
Figure 28:
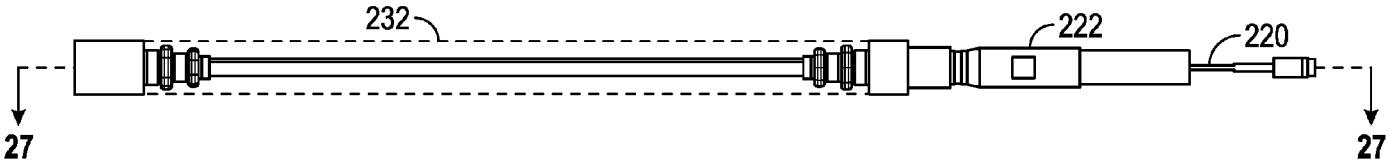
Figures 29, 30:
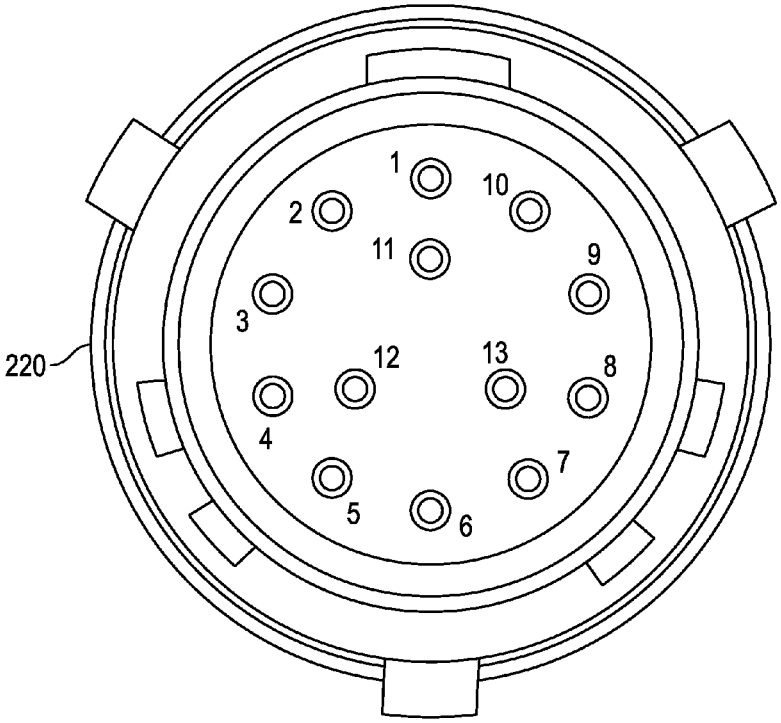

FIGS. 24 and 25 show an enlarged view of the insulating segment 232 in parallel with the outer communication segment 238. The insulating segment 232 can be coupled to the electronics module 218 via connector 220 and contact assembly 222 (as shown in FIGS. 26-30). The contact assembly 222 can comprise a plurality of discrete electrical conductors (as shown in FIG. 29), that provide various electrical connection conditions (FIG. 30) between the segment 232 and the electronics module 218. As shown in FIG. 27, the contact assembly 222 includes a proximal end (P5) that couples to the distal end (P4) of the segment 232. The distal end (P7) of the contact assembly 222 couples to the electronic module 218. The connector 220 is positioned around the contact assembly 222 and attaches to the segment 232 and to other distal segments of the inner shaft.

In some embodiments, liquid pulse telemetry can be used to transmit data from underground portions of the drill string to the surface. In liquid pulse telemetry, data is encoded (e.g., digitally) in pressure waves or pressure fluctuations in a fluid conducted along the drilling string. The fluid can comprise a functional drilling fluid, such as water or mud. In some embodiments, one or more valves and/or pumps along a fluid conduit (e.g., the annular gap 34 between the inner and outer shaft assemblies) can be operated to create such pressure waves. The pressure waves can propagate within the fluid to the surface where they are received with pressure sensors, and the pressure signals can be processed to decode the drilling related data. Similarly, surface-to-downhole communications can also be transmitted using pressure waves in the fluid. Liquid pulse telemetry can be used in conjunction with and/or instead of other forms of wireless communications described herein to communicate data between an underground location and a surface location.

For purposes of this description, certain aspects, advantages, and novel features of the embodiments of this disclosure are described herein. The disclosed methods, apparatuses, and systems should not be construed as limiting in any way. Instead, the present disclosure is directed toward all novel and nonobvious features and aspects of the various disclosed embodiments, alone and in various combinations and sub-combinations with one another. The methods, apparatuses, and systems are not limited to any specific aspect or feature or combination thereof, nor do the disclosed embodiments require that any one or more specific advantages be present or problems be solved.

Although the operations of some of the disclosed methods are described in a particular, sequential order for convenient presentation, it should be understood that this manner of description encompasses rearrangement, unless a particular ordering is required by specific language. For example, operations described sequentially may in some cases be rearranged or performed concurrently. Moreover, for the sake of simplicity, the attached figures may not show the various ways in which the disclosed methods can be used in conjunction with other methods. Additionally, terms like "determine" and "provide" are sometimes used to describe the disclosed methods. These terms are high-level abstractions of the actual operations that are performed. The actual operations that correspond to these terms may vary depending on the particular implementation and are readily discernible by one of ordinary skill in the art.

As used herein, the terms "a", "an" and "at least one" encompass one or more of the specified element. That is, if two of a particular element are present, one of these elements is also present and thus "an" element is present. The terms "a plurality of" and "plural" mean two or more of the specified element. As used herein, the term "and/or" used between the last two of a list of elements means any one or more of the listed elements. For example, the phrase "A, B, and/or C" means "A," "B," "C," "A and B," "A and C," "B and C" or "A, B and C." As used herein, the term "coupled" generally means physically, mechanically, chemically, fluidly, electrically, and/or magnetically coupled or linked and does not exclude the presence of intermediate elements between the coupled or associated items absent specific contrary language.

Unless otherwise indicated, all numbers expressing properties, sizes, percentages, measurements, distances, ratios, and so forth, as used in the specification or claims are to be understood as being modified by the term "about." Accordingly, unless otherwise indicated, implicitly or explicitly, the numerical parameters set forth are approximations that may depend on the desired properties sought and/or limits of detection under standard test conditions/methods. When directly and explicitly distinguishing embodiments from discussed prior art, numbers are not approximations unless the word "about" is recited.

In view of the many possible embodiments to which the disclosed technology may be applied, it should be recognized that the illustrated embodiments are only preferred examples and should not be taken as limiting the scope of the disclosure. Rather, the scope of the disclosure is at least as broad as the scope of the following claims. We therefore claim all that comes within the scope of these claims.

The invention claimed is:

1. A communication segment for a dual-shaft underground directional drilling system, the communication segment comprising:

an inner shaft, and an outer shaft positioned around the inner shaft such that the inner and outer shafts are rotatable independently of each other;

wherein the inner shaft is configured to be coupled to inner shafts of adjacent segments of a dual-shaft underground directional drilling system such that, when coupled together, the inner shaft can transfer forces between the inner shafts of adjacent segments;

wherein the outer shaft is configured to be coupled to outer shafts of adjacent segments of a dual-shaft underground directional drilling system such that, when coupled together, the outer shaft can transfer forces between the outer shafts of adjacent segments;

wherein the outer shaft comprises a first longitudinal portion, a second longitudinal portion, and a gap portion between the first and second longitudinal portions that provides electrical insulation between the first and second longitudinal portions;

wherein the communication segment is configured to produce a voltage difference between the first and second longitudinal portions of the outer shaft sufficient to cause an electrical pulse to transfer from one of the first and second longitudinal portions, through the gap portion, and to the other of the first and second longitudinal portions;

wherein the inner shaft comprises a first end portion, a second end portion, and electrical insulation between the first and second end portions that electrically isolates the first and second end portions, such that the inner shaft provides sufficient electrical resistance between the first and second longitudinal portions of the outer shaft to allow the voltage difference to form;

wherein the inner shaft comprises a connector rod having a first axial end that is electrically coupled to the first end portion and a second axial end that is electrically insulated from the second end portion; and wherein the communication segment is configured to produce a plurality of such electrical pulses to wirelessly communicate drilling related data from an underground drilling location to an above ground location.

2. The communication segment of claim 1, wherein the second axial end of the connector rod is electrically insulated from the second end portion by a layer of insulating material positioned circumferentially around the second axial end of the connector rod.

3. The communication segment of claim 1, wherein the second axial end of the connector rod is secured to the second end portion by a fastener that is electrically coupled to the connector rod and electrically isolated from the second end portion by at least one insulating spacer or washer.

4. The communication segment of claim 3, wherein the fastener extends axially through an aperture in the second end portion without contacting the second end portion.

5. The communication segment of claim 1, wherein the electrical insulation of the inner shaft comprises a composite material that forms a radial outer surface of the inner shaft extending between the first and second end portions of the inner shaft.

6. The communication segment of claim 5, wherein the first and second end portions of the inner shaft comprise respective neck portions forming radial recesses, and the composite material that forms a radial outer surface of the inner shaft extends radially into the radial recesses.

7. A dual-shaft underground directional drilling system comprising the communication segment of claim 1, wherein the drilling system comprises an inner shaft assembly including the inner shaft of the communication segment, and wherein the drilling system comprises an outer shaft assembly including the outer shaft of the communications segment.

8. The drilling system of claim 7, further comprising an electronic communication controller electrically coupled to the first and second longitudinal portions of the outer shaft, wherein the communication controller is configured to generate voltage differences between the first and second longitudinal portions that cause electrical pulses to transfer from one of the first and second longitudinal portions, through the gap portion, and to the other of the first and second longitudinal portions to wirelessly communicate drilling related data from an underground location to an above ground location.

9. The drilling system of claim 7, further comprising a magnetic sensor system configured to determine a rotational orientation of the inner shaft assembly relative to the outer shaft assembly.

10. The drilling system of claim 9, wherein the magnetic sensor system comprises at least two magnets coupled to the outer shaft assembly and a magnetic sensor coupled to the inner shaft assembly, wherein the magnetic sensor is configured to sense the circumferential position of the at least two magnets relative to the inner shaft assembly.

11. The drilling system of claim 9, further comprising a drilling head positioned distal to the communications segment, wherein the magnetic sensor system is positioned axially between the communications segment and the drilling head.

12. The drilling system of claim 7, wherein the inner shaft assembly comprises a fluid bypass segment coupled to the inner shaft of the communication segment, wherein the fluid bypass segment comprises an inner lumen and two axially spaced part radial conduits fluidly coupling the inner lumen to an annular passageway between the inner shaft assembly and the outer shaft assembly.

13. The drilling system of claim 12, wherein the outer shaft assembly comprises a bearing segment coupled to the outer shaft of the communication segment and positioned around the fluid bypass segment, the bearing segment comprising a bearing bore that fits closely around the fluid bypass segment and is positioned axially between the two axially spaced part radial conduits of the fluid bypass segment such that fluid in the annular passageway can bypass the bearing bore by traveling through the inner lumen of the fluid bypass segment.

14. The drilling system of claim 7, further comprising a mud motor positioned proximal to the communications segment.

15. The drilling system of claim 7, wherein the inner shaft assembly comprises a sensor module, an electronics module, and a battery module positioned distal to the communications segment.

16. The drilling system of claim 15, wherein the sensor module, the electronics module, and the battery module are contained within an inner lumen of the inner shaft assembly.

17. The drilling system of claim 15, wherein the sensor module comprises a gyroscopic sensor adapted to determine an orientation of the drilling system.

18. The drilling system of claim 15, where a combined axial length of the sensor module, the electronics module, and the battery module is less than 200 inches.

19. The drilling system of claim 15, where an axial distance between the communications segment and a distal end of the inner shaft assembly is less than 200 inches.

20. A communication segment for a dual-shaft underground directional drilling system, the communication segment comprising:

an inner shaft, and an outer shaft positioned around the inner shaft such that the inner and outer shafts are rotatable independently of each other;

wherein the inner shaft is configured to be coupled to inner shafts of adjacent segments of a dual-shaft underground directional drilling system such that, when coupled together, the inner shaft can transfer forces between the inner shafts of adjacent segments;

wherein the outer shaft is configured to be coupled to outer shafts of adjacent segments of a dual-shaft underground directional drilling system such that, when coupled together, the outer shaft can transfer forces between the outer shafts of adjacent segments;

wherein the outer shaft comprises a first longitudinal portion, a second longitudinal portion, and a gap portion between the first and second longitudinal portions that provides electrical insulation between the first and second longitudinal portions;

wherein the communication segment is configured to produce a voltage difference between the first and second longitudinal portions of the outer shaft sufficient to cause an electrical pulse to transfer from one of the first and second longitudinal portions, through the gap portion, and to the other of the first and second longitudinal portions;

wherein the inner shaft comprises a first end portion, a second end portion, and electrical insulation between the first and second end portions that electrically isolates the first and second end portions, such that the inner shaft provides sufficient electrical resistance between the first and second longitudinal portions of the outer shaft to allow the voltage difference to form;

wherein the electrical insulation of the inner shaft comprises a composite material that forms a radial outer surface of the inner shaft extending between the first and second end portions of the inner shaft;

wherein the first and second end portions of the inner shaft comprise respective neck portions forming radial recesses, and the composite material that forms a radial outer surface of the inner shaft extends radially into the radial recesses; and wherein the communication segment is configured to produce a plurality of such electrical pulses to wirelessly communicate drilling related data from an underground drilling location to an above ground location.

21. A dual-shaft underground directional drilling system comprising a communication segment, the communication segment comprising:

an inner shaft, and an outer shaft positioned around the inner shaft such that the inner and outer shafts are rotatable independently of each other;

wherein the inner shaft is configured to be coupled to inner shafts of adjacent segments of a dual-shaft underground directional drilling system such that, when coupled together, the inner shaft can transfer forces between the inner shafts of adjacent segments;

wherein the outer shaft is configured to be coupled to outer shafts of adjacent segments of a dual-shaft underground directional drilling system such that, when coupled together, the outer shaft can transfer forces between the outer shafts of adjacent segments;

wherein the outer shaft comprises a first longitudinal portion, a second longitudinal portion, and a gap portion between the first and second longitudinal portions that provides electrical insulation between the first and second longitudinal portions;

wherein the communication segment is configured to produce a voltage difference between the first and second longitudinal portions of the outer shaft sufficient to cause an electrical pulse to transfer from one of the first and second longitudinal portions, through the gap portion, and to the other of the first and second longitudinal portions;

wherein the inner shaft comprises a first end portion, a second end portion, and electrical insulation between the first and second end portions that electrically isolates the first and second end portions, such that the inner shaft provides sufficient electrical resistance between the first and second longitudinal portions of the outer shaft to allow the voltage difference to form; and wherein the communication segment is configured to produce a plurality of such electrical pulses to wirelessly communicate drilling related data from an underground drilling location to an above ground location;

wherein the drilling system comprises an inner shaft assembly including the inner shaft of the communication segment, and wherein the drilling system comprises an outer shaft assembly including the outer shaft of the communications segment; and wherein the inner shaft assembly comprises a fluid bypass segment coupled to the inner shaft of the communication segment, wherein the fluid bypass segment comprises an inner lumen and two axially spaced part radial conduits fluidly coupling the inner lumen to an annular passageway between the inner shaft assembly and the outer shaft assembly.

22. The drilling system of claim 21, wherein the outer shaft assembly comprises a bearing segment coupled to the outer shaft of the communication segment and positioned around the fluid bypass segment, the bearing segment comprising a bearing bore that fits closely around the fluid bypass segment and is positioned axially between the two axially spaced part radial conduits of the fluid bypass segment such that fluid in the annular passageway can bypass the bearing bore by traveling through the inner lumen of the fluid bypass segment.

* * * * *